US005348117A

United States Patent [19]

Pickering

[11] Patent Number: 5,348,117

[45] Date of Patent: Sep. 20, 1994

[54] RESCUE SYSTEM

[76] Inventor: Gregory R. Pickering, 362 Jack Rettie Court, New Market, Ontario, Canada, L3Y 7X8

[21] Appl. No.: 42,266

[22] Filed: Apr. 2, 1993

Related U.S. Application Data

[63] Continuation-in-part of Ser. No. 928,009, Aug. 12, 1992.

[51] Int. Cl.[5] ..... B66D 5/00; A62B 1/14

[52] U.S. Cl. ..... 182/5; 182/236

[58] Field of Search ..... 182/5–7, 182/191–193, 241, 236, 71; 188/65.1–65.4

[56] References Cited

U.S. PATENT DOCUMENTS

| | | | |
|---|---|---|---|
| 790,001 | 5/1905 | Perry | 182/236 |
| 1,071,502 | 8/1913 | Boufford | 182/241 X |
| 1,961,081 | 5/1934 | Schrader | 188/65.2 X |
| 3,602,483 | 8/1971 | Russell | 254/157 |
| 3,703,218 | 11/1972 | Brda | 182/5 |
| 3,717,219 | 2/1973 | Hoffman | 188/65.4 X |
| 3,759,346 | 9/1973 | Brda | 182/5 |
| 3,807,696 | 4/1974 | Brda | 182/192 X |
| 4,580,658 | 4/1986 | Brda | 182/5 |
| 4,883,146 | 11/1989 | Varner et al. | 188/65.1 |
| 4,938,435 | 7/1990 | Varner et al. | 188/184 |
| 5,038,888 | 8/1991 | Varner et al. | 182/5 |
| 5,070,962 | 12/1991 | Varner | 182/3 |
| 5,131,491 | 7/1992 | Varner et al. | 182/5 |
| 5,168,958 | 12/1992 | Wullimann | 182/236 |

OTHER PUBLICATIONS

Rollgliss Company Flyer for the Rollgliss Standard.

*Primary Examiner*—Alvin C. Chin-Shue
*Attorney, Agent, or Firm*—Nixon & Vanderhye

[57] ABSTRACT

A rescue system includes a hoist including a backplate; a rope drum mounted on the backplate for rotation about an axis extending substantially perpendicular to the backplate, the rope drum having a rope engaging surface located between a pair of circular end flanges; a rope guide fixed to the backplate, the rope guide formed by a pair of elongated laterally spaced legs connected at opposite ends of the rope guide to define therebetween at least one rope slot, the rope guide having an arcuate shape conforming substantially to the circular end flanges of the rope drum; a generally T-shaped rope lock bar mounted on a forward end of the rope guide, the lock bar including a stem and a cross bar, the cross bar extending substantially parallel to an axis of rotation of the rope drum; and a lock mounted on the backplate for movement between engaged and disengaged positions, the lock including a cam which, when in the engaged position, permits movement of a rope in one direction but not in the opposite direction.

18 Claims, 5 Drawing Sheets

RESCUE SYSTEM

RELATED APPLICATIONS

This application is a continuation-in-part of copending application Ser. No. 07/928,009; filed Aug. 12, 1992.

BACKGROUND AND SUMMARY OF THE INVENTION

The present invention relates to rescue apparatus which includes as an essential element a rescue hoist designed for lowering or lifting persons or loads quickly and easily without a substantial effort on the part of the operator of the system. Unique components of this system in accordance with this continuation-in-part application include a haul-lock device movable between engaged and disengaged positions and which, when engaged, allows raising of a load as normal, but prevents descent even if the operator releases the control rope. Another unique component in accordance with this continuation-in-part application is a lock-off bar which allows the operator to lock the control rope, thereby securing the load and holding it without further effort on the part of the operator.

One conventional hoist device includes a rope drum supported on a bolt extending from a bracket by a free wheeling bearing or so-called roller friction clutch which permits the rope drum to freely rotate in one direction (counter clockwise, in the exemplary description) but which blocks rotation of the drum in the opposite direction (clockwise in the exemplary description). In a typical load lowering application, a rope is wound around the drum at least 1 ½ and usually 2 ½ (depending on rope diameter) turns so that a braking force is applied to the rope as it glides over the drum surface in the direction in which the drum rotation is blocked. In other words, the braking action results from the friction between the rope and the drum surface as the rope is wound onto and then off the non-rotating drum under the downward loading influence of the person (or object) being lowered. The load end of the rope is generally connected to one or more pulleys downstream of the hoist which provide a mechanical lifting advantage so that the operator need only exert a slight counterpull in order to control the descent of the person being lowered.

Hoisting devices of this type are disclosed in U.S. Pat. Nos. 3,703,218 and 3,807,696. In the latter patent, improved rope guide devices for the rope drum are disclosed. One arc-shaped guide is in the form of two laterally spaced bails arranged along a portion of the circumference of the rope drum and connected at the ends, forming a slot through which the rope may pass. The arrangement is such that one end of the rope, the so-called control end of the rope, may be guided onto the drum through the rope guide slot from various directions relative to the drum.

In applicant's parent application Ser. No. 07/928,009, the entirety of which is incorporated by reference, an improved hoist device is disclosed which contains several unique and advantageous features. For example, the cylindrical rope engaging surface of the rope drum is modified to include an upwardly and rearwardly directed taper in that portion of the drum closest to the hoist support bracket or backplate. The tapered roller drum prevents overlapping during raising even with no lower rope guide block installed on the backplate, and thereby greatly improves the efficiency of the system by the attendant reduction of friction. More specifically, the tapered surface of the drum forces the rope coming onto the drum during a lifting operation to slide off the taper towards the front of the drum, so that there is always space created for new rope to come onto the rear of the drum. This action is described in more detail in the '009 application.

The '009 parent application also describes an improved arcuate guide cage which prevents the rope from overlapping itself, and which prevents the rope from slipping between the guide and the drum.

The parent application also describes a unique centrifugal brake device for use with the hoist which constantly senses rope speed while lowering, and if an excessive speed is reached, grips the rope and prevents further descent.

This continuation-in-part application relates to two improved features which may be incorporated into a hoist device generally of the type disclosed in the '009 application. During a rescue operation involving lowering a rescue worker or a victim, it is often necessary to stop the lowering process and lock off the rope being used in order to check the system, check the victim, or change the system's rigging by, for example, converting it to a raising system. To achieve this end, this invention provides a T-shaped device located at the forward end of the arcuate rope guide (with the "cross bar" of the T extending transversely relative to the rope windings, i.e., parallel to the axis of rotation of the drum). This device permits the operator to lock the control end of the rope, thereby securing the load and holding it without further intervention on the part of the operator. Because this T-shaped bar is utilized in conjunction with a system as described in the '009 parent application, it experiences very little load, as the system itself by nature absorbs most of the load through the 1 ½ to 2 ½ wraps around the roller drum. Additional load is absorbed by the rope bending around the rope guide cage as described in the parent application. This T-shaped bar provides a very strong mechanism to lock off the rope as it emulates a tensionless anchor (a device used to anchor a rope, without decreasing its strength, by wrapping the rope several times around an essentially round object before tying the end off). In this way, the wraps of rope absorb much of the load before the tie-off is loaded.

The second improved feature in accordance with this continuation-in-part application is a manual haul-lock device which, when engaged, allows a load to be raised in normal operation, but prevents the load from being lowered. More specifically, when the lock is engaged, the load cannot descend even if the rope is let go, for example, between pulls, in the event of operator incapacitation, or while performing various rigging operations on the system. When the locking device is not engaged, the system operates as normal and raising and lowering may be performed in the usual manner.

This manual lock device includes a body portion mounted to the hoist backplate, a locking cam mounted for movement between operative (engaged) and inoperative (disengaged) positions, a torsion spring which normally biases the cam toward the rope, and a cam handle and spring loaded knob assembly which is used to move the cam between engaged and disengaged positions.

Both of the above mentioned devices will be described fully hereinbelow.

In its broader aspects, therefore, the present invention relates to a rescue system comprising a hoist including a backplate; a rope drum mounted on the backplate for rotation about an axis extending substantially perpendicular to the backplate, the rope drum having a rope engaging surface located between a pair of circular end flanges; a rope guide fixed to the backplate, the rope guide formed by a pair of elongated laterally spaced legs connected at opposite ends of the rope guide to define therebetween at least one rope slot, the rope guide having an arcuate shape conforming substantially to the circular end flanges of the rope drum; a generally T-shaped rope lock bar mounted on a forward end of the rope guide, the lock bar including a stem and a cross bar, the cross bar extending substantially parallel to an axis of rotation of the rope drum; and a lock mounted on the backplate for movement between engaged and disengaged positions, the lock including a cam which, when in the engaged position, permits movement of a rope in one direction but not in the opposite direction.

In another broad aspect, the invention relates to a rescue system comprising a hoist including a backplate; a rope drum mounted on the backplate, the rope drum capable of rotation in one direction only; the rope drum having a front and rear end flange on either side of a rope engaging surface; an arcuate rope guide including a thru slot fixed to the backplate and extending partially about the drum; and a cam lock assembly mounted to the backplate for rotation about an axis parallel to an axis of rotation of the rope drum, the cam lock assembly including a cam movable between an operative and inoperative position.

In still another aspect, the invention relates to a rescue system comprising a hoist including a backplate; a rope drum mounted on the backplate, the rope drum capable of rotation in one direction only; the rope drum having a front and rear end flanges on either side of a rope engaging surface; an arcuate rope guide including a thru slot fixed to the backplate and extending partially about the drum; a substantially T-shaped rope lock bar mounted on the rope guide and extending substantially transverse to the rope guide to permit a rope extending through the rope guide and partially about the drum to be wrapped about the lock bar.

Additional objects and advantages of the subject invention will become apparent from the detailed description which follows.

DETAILED DESCRIPTION OF THE DRAWINGS

Figure 1:
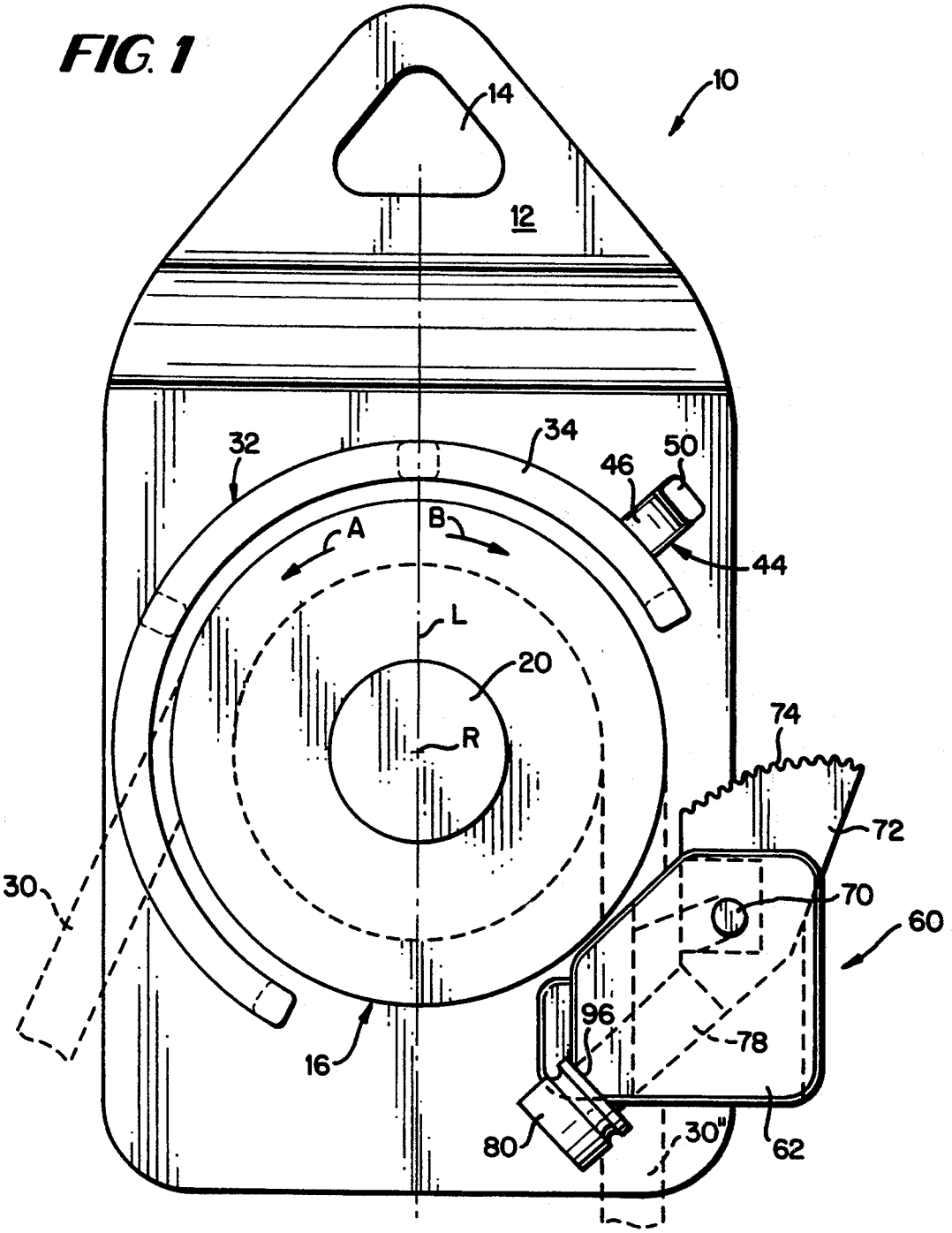
FIG. 1 is a front view of a rescue hoist in accordance with an exemplary embodiment of the invention.
Figure 2:
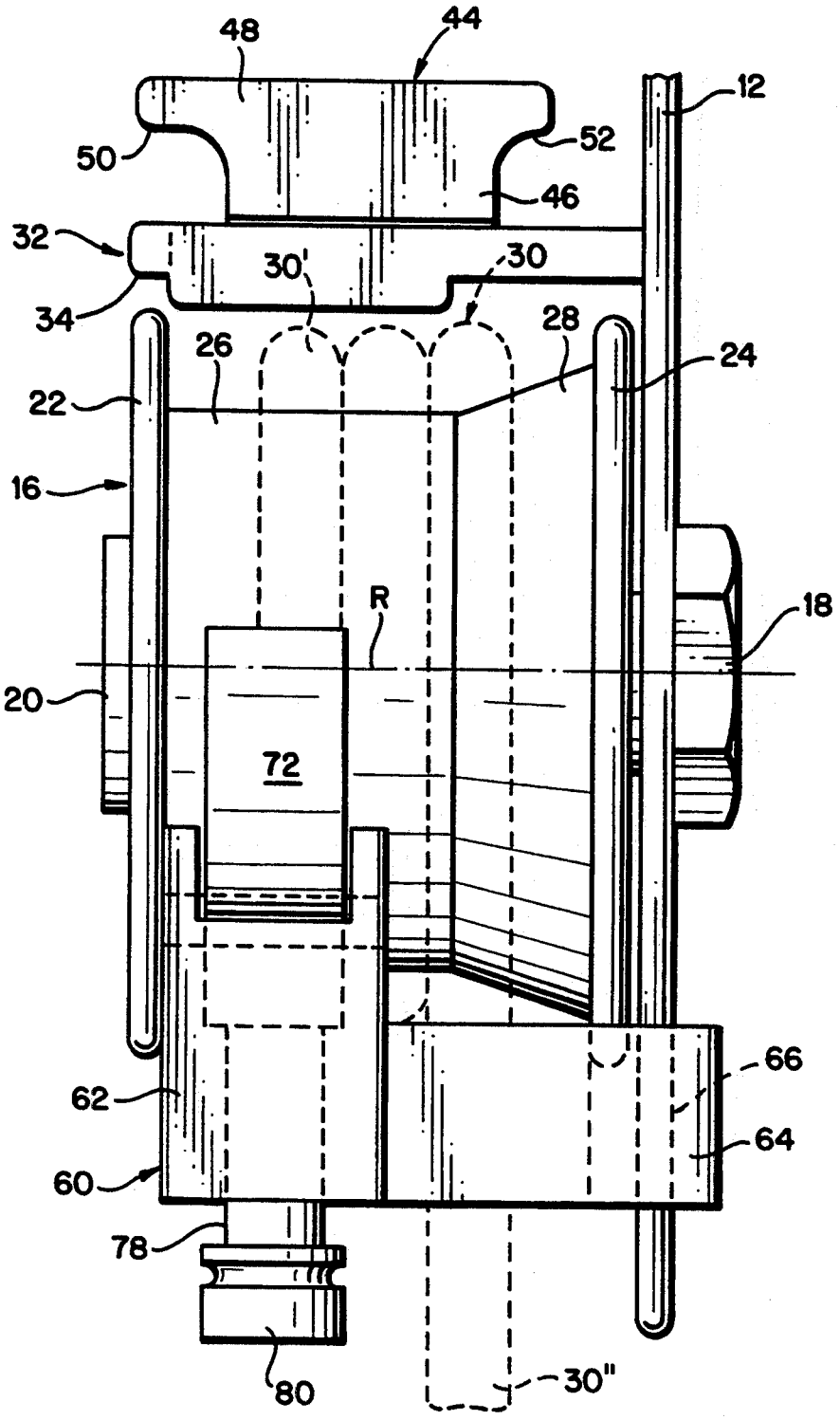
FIG. 2 is a side view of the rescue hoist illustrated in FIG. 1.

With reference especially to FIGS. 1 and 2, the rescue hoist 10 includes a carrier bracket or backplate 12 provided with a mounting hole 14. A tapered roller drum 16 is rotatably mounted on the backplate 12 by means of a bolt 18 which extends through the backplate, through the roller drum 16 where it is capped by a nut or other retention means, with or without a cover disc 20. The roller drum 16 is provided with forward and rearward end flanges 22 and 24, respectively, and is rotatably supported on the bolt by means of a conventional freewheeling roller locking friction clutch (not shown) which permits the free rolling rotation of the rope drum 16 in one direction, but blocks rotation of the drum 16 in the opposite direction. Thus, as viewed in FIG. 1, the drum 16 is rotatable in the direction of arrow A and locked against rotation in the direction of arrow B. As already noted, the freewheeling roller locking friction clutch is similar to those used in conventional hoist systems and therefore need not be described in further detail herein.

As best seen in FIG. 2, the drum 16 in accordance with the invention has a substantially cylindrical surface portion 26 and a conical or tapered surface portion 28, the latter flaring radially outwardly in a rearward direction from the cylindrical surface 26 to the end flange 24 closest to the plate 12.

A rope 30 (shown in phantom), which is in the case is a rope having a diameter of approximately ½ inch, is wound around the circumference of the rope drum 16.

During a raising operation, the tapered surface 28 forces the rope 30 as it comes onto the drum 16 to slide off the tapered surface 28 toward the front of the drum, thus clearing a space for new rope to come onto the rear of the drum as described in more detail in the '009 parent application.

Figure 3:
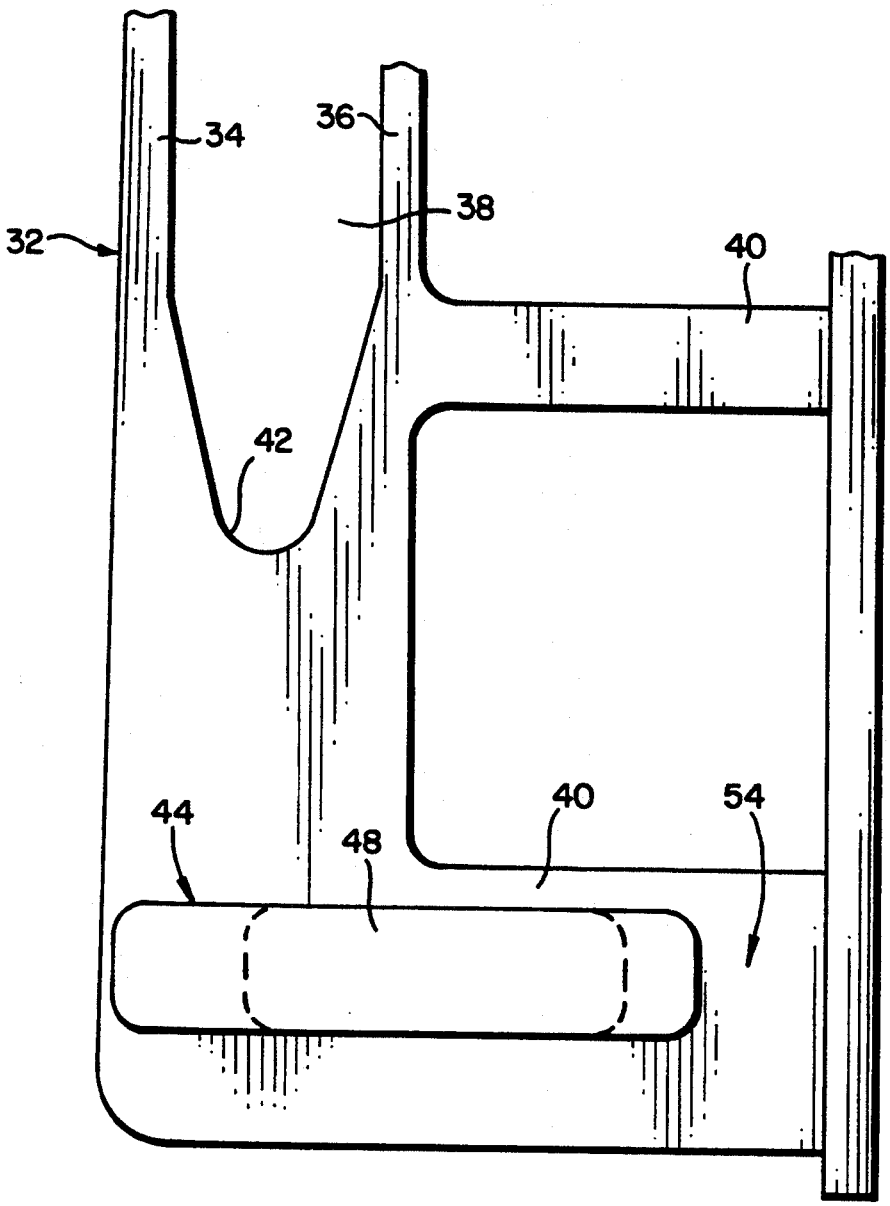
FIG. 3 is a partial top view of the arcuate rope guide in accordance with this invention.

The rope guide cage 32 (like the rope guide cage in the '009 parent application), includes a pair of substantially parallel legs 34, 36 (FIG. 3) which are spaced from each other by bight portions (not shown) as described and illustrated in the parent application. As a result of this construction, a pair of elongated slot-like openings are formed, one behind the other in the elongated direction of the rope guide cage. The forward end of one such slot 38 is seen in FIG. 3. The rope guide cage is also provided with a plurality of mounting legs 40 which are spaced from each other in the longitudinal or arcuate direction of the rope guide cage 32 and which extend substantially perpendicularly relative to the parallel legs 34, 36. Each of the mounting legs 40 is formed with a threaded blind bore (not shown) to facilitate attachment of the rope guide cage to the backplate 12 by means of screw fasteners (not shown) extending through the backplate 12 and into the threaded blind bores. The forward opening 38 is formed with a wedge groove 42 at its forwardmost end for a purpose described in the above identified '009 parent application.

With reference to FIG. 1 in particular, it may be seen that the rope guide cage 32 extends over approximately 210° of the circumference of the roller drum 16 and crosses over a vertical centerline L through the aligned mounting hole 14 in the backplate 12 and the axis of rotation R of the drum 16.

In accordance with one aspect of the present invention, a generally T-shaped lock-off bar 44 is bolted (or secured by other suitable means) to a forwardmost end of the rope guide cage 32. The lock-off bar 44 includes a stem 46 and a "cross bar" 48 which is oriented substantially transversely to the rope windings as best seen in FIG. 2. The "cross bar" 48 effectively forms forward and rearward flanges or lugs 50 and 52, respectively, on either side of the stem 46.

To use the lock-off bar 44, the control end of the rope 30 (i.e., that end of the rope coming onto the drum from the left as viewed in FIG. 1), is brought upwardly through a slot in the rope guide cage and onto the drum 16. The rope is then bent clockwise around the rope guide cage, approximately 180°, under the lug 50 and then 180° around the stem 46, under the rear flange lug in the space 54, between the bar 44 and the backplate 12). To free the rope from this locked position, the operator simply pulls the control end of the rope 30 out from under the rear lug 52, back around the stem 46, and out from under the front lug 50. As already noted hereinabove, this lock-off bar device allows the operator to lock the rope off, thereby securing the load and temporarily holding it for a period of time in order to perform related activities. For example, during a rescue operation involving a lowering operation, it is often necessary to stop the lowering process in order to check the condition of the system, check the victim or change the system's rigging. When these activities are completed, the rope is released as described above.

With reference now to FIGS. 1, 2, 4 and 5, the manual lock device 60 in accordance with this invention includes a body portion having a generally L-shape (when viewed from the side in FIG. 2) with a forward cam mounting portion 62 and a rearward plate mounting portion 64. The latter is provided with a slot 66 which enables the lock to be mounted to the backplate 12 with the assistance of appropriate fasteners (not shown). The lock 60 may thus be seen to extend generally perpendicularly away from the backplate 12, and generally parallel to the axis of rotation R of the rope drum 16. The cam mounting portion 62 lies adjacent the forward end of the cylindrical surface 26 of the drum 16, such that a pivotally mounted handle/cam assembly 68 may be moved toward or away from a forwardmost winding 30' of the rope 30 as described in greater detail below.

Figure 5:
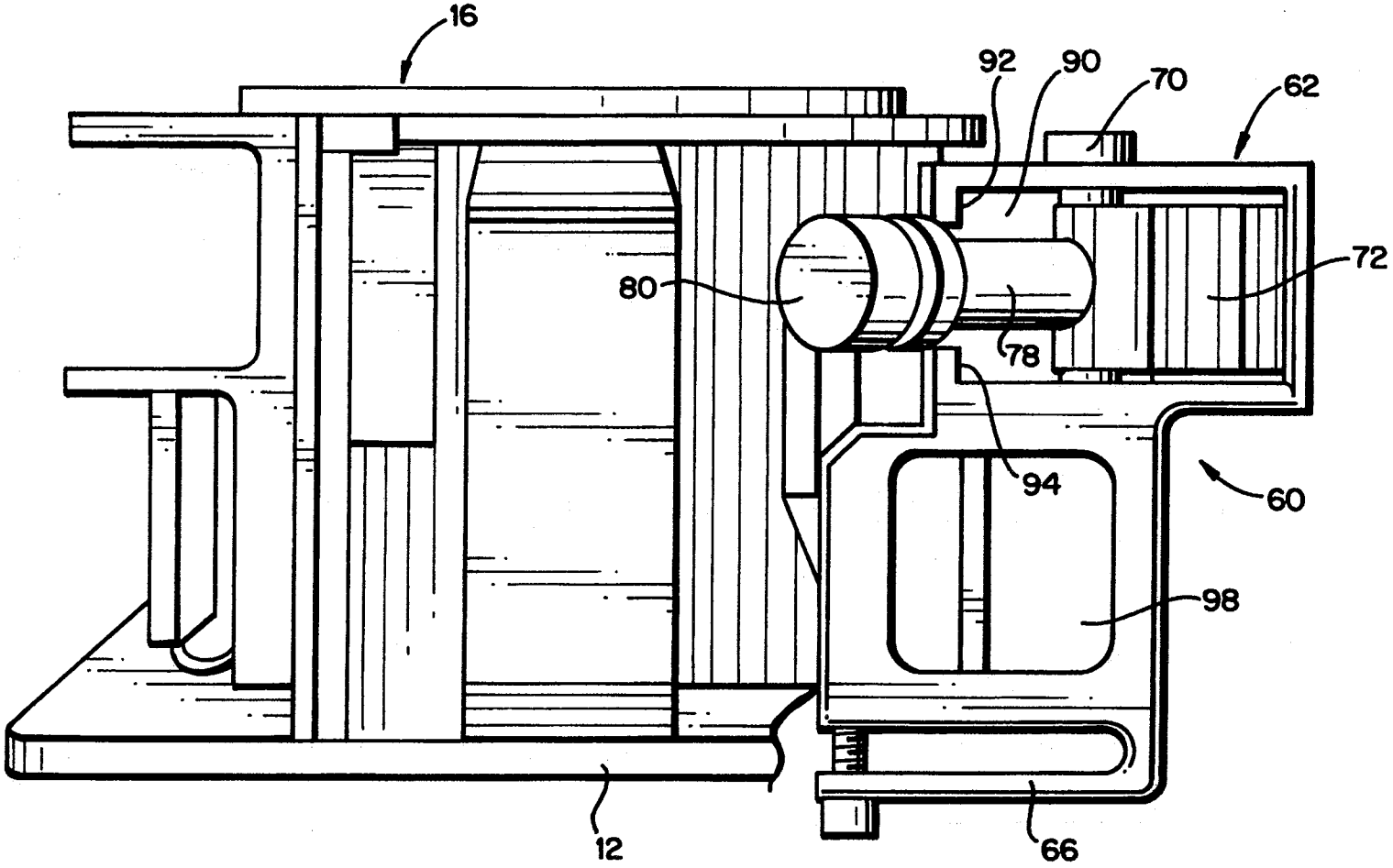
FIG. 5 is a partial bottom view of the rescue hoist shown in FIGS. 1 and 2.

The cam mounting end 62 of the lock 60 is essentially hollow (as best seen in FIG. 5), thereby enabling the handle/cam assembly 68 to be pivotally secured within the lock body by means of pin 70 which extends parallel to the drum axis R. A conventional torsion spring (not shown) is mounted on the pin for biasing the handle/-cam assembly 68 in a counterclockwise or rope engaging direction (as viewed in FIG. 1).

Figure 4:
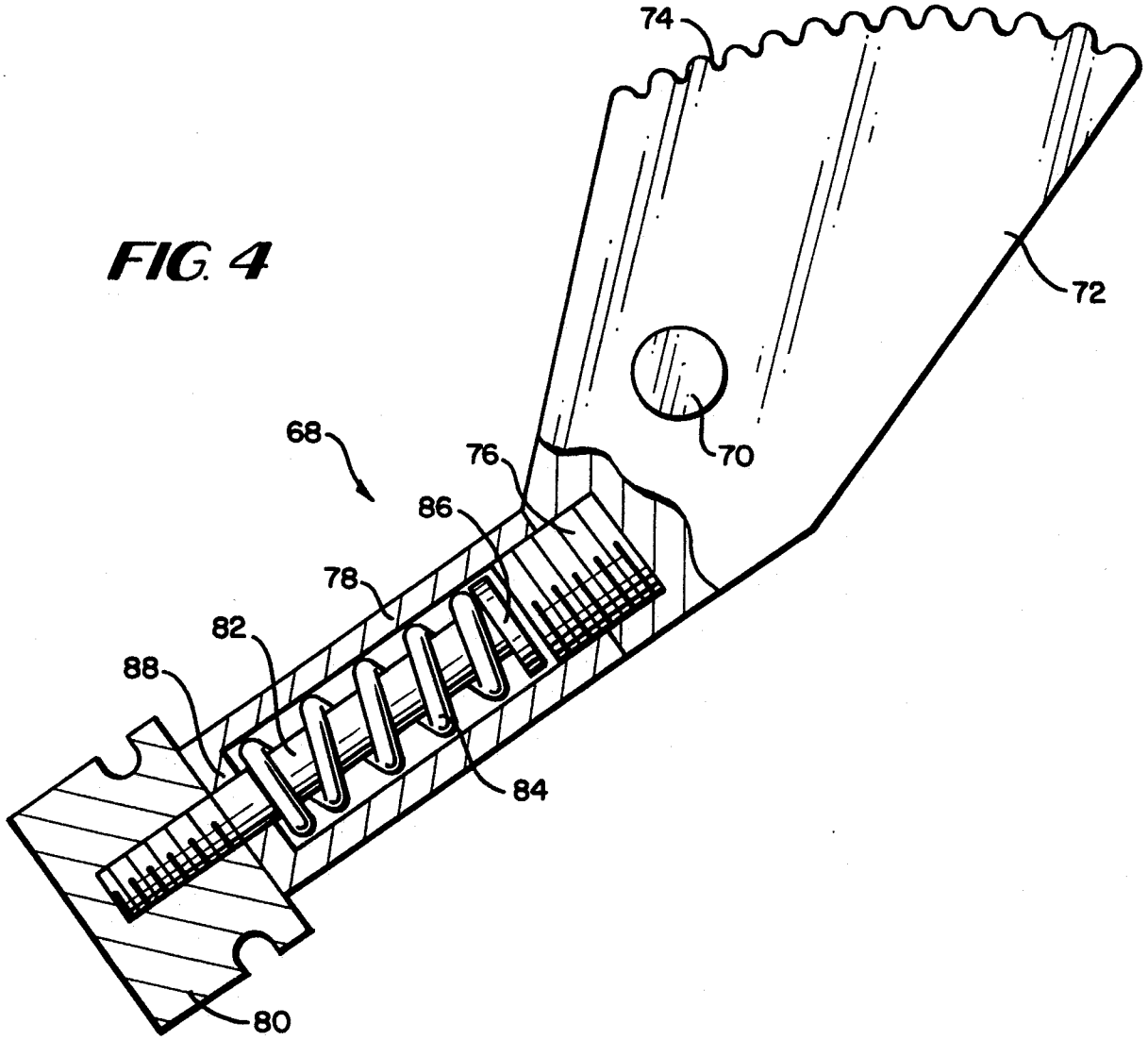
FIG. 4 is an isolated detail of a locking cam and associated knob structure in accordance with the invention.

With specific reference to FIG. 4, the handle/cam assembly 68 includes a cam 72 having a curved and serrated rope engaging surface 74 designed to cooperate with the placement of pin 70 so that, when the surface 74 is rotated in a counterclockwise direction as viewed in FIG. 1, the rope 30 will wedge between drum surface 26 and cam surface 74 as described in greater detail below.

The cam 72 is fixed via a threaded connector stud 76 to a cylindrical barrel element barrel 78. The barrel 78, in turn, mounts a knob or handle 80 at its rearward end, the knob threadably connected to a knob extension rod 82 within the barrel. A compression spring 84 extends between an enlarged head 86 of the extension rod 82 and the end wall 88 of the barrel 78, thereby biasing the knob 80 toward the barrel so that the knob 80 normally engages the end wall 88 of the barrel as shown in FIG. 4.

With specific reference to FIGS. 1 and 5, and as noted above, the cam mounting end 62 of the lock device 60 includes a hollow space 90 within which the knob/cam assembly 68 is free to pivot about pin 70 within apparent limits. This space is defined in part by a pair of flanges 92, 94 at one side of the space (to the left as viewed in FIG. 1), thereby creating a slot which lies along an inclined edge 96 of the cam mounting end 62 of the lock. When the knob/cam assembly is rotated to the position shown in FIGS. 1 and 5, the knob 80 is biased (by spring 84) against the flanges 92, 94, and the assembly 68 is thus held in a disengaged or inoperative position.

In this disengaged position, a load may be raised or lowered in the usual manner without interference of the lock device 60. To engage the cam/knob assembly, the knob 80 is pulled away from the barrel 78 against the action of compression spring 84, so that the assembly can be rotated counterclockwise (as viewed in FIG. 1), and so that the assembly 68 is free to move within the space 92. The knob 80 is then released.

Once the knob 80 is freed from the slot defined by flanges 92, 94, the torsion spring associated with pin 70 takes over and causes the assembly 68 to pivot counterclockwise to a rope engaging position.

It should be noted that the cam surface 74 grabs the rope on its low tension side, i.e., one or two wraps upstream of the load strand. This is best seen in FIG. 2, with cam surface 74 engaging the low tension wrap 30', while the load end or wraps 30'' of the rope extends downwardly through aperture 98 (see FIG. 5). This arrangement serves two important purposes: 1) by grabbing the rope on a low tension wrap, the force required to hold the load is minimized as is the stress placed on the device and the rope; 2) more importantly, grabbing the rope on a low tension wrap allows the user to disengage the haul-lock 60 while it is under load. For example, if the system is rigged for raising what is known in the industry as a "Z-haul" or "Z-rig" and lowering is required, the device 60 will hold the load while derigging the raising configuration, and also allow disengagement to transfer the load to the drum's internal rope friction brake. With regard to the spring loaded knob 80, this specific construction is provided for two reasons: 1) Although the force required to disengage the device 60 under load is small (as a result of grabbing the rope on a low tension wrap), obviously some force is required, and it has been found that approximately a three inch handle (inclusive of knob 80 and barrel 78) provides sufficient leverage. The length is also sufficient to permit the user to easily grasp the knob. However, it is desirable to have the lock knob 80 out of the way as much as possible to avoid accidental disengagement during operation, and therefore the spring loaded extension and disengagement slot arrangement makes this possible; 2) For the purpose of holding the 72 cam in an open or disengaged position, the spring loaded knob 80 exerts pressure on the slot in the body to accomplish this without adding an additional component to the device.

In use, when the cam 72 is in the engaged position and the rope moves clockwise on the roller drum 16, for example, during descent, the cam surface 74 compresses the rope between itself and the roller drum surface 26 and stops further movement, i.e., descent of the rope. This provides an important safeguard against operator error in case the operator should let go of the rope which would otherwise cause the load to descend, perhaps uncontrollably. When raising is commenced, the rope moving counterclockwise will cause the cam 72 to pivot clockwise and, although still under torsion and lightly contacting the rope, the cam permits movement of the rope in this direction, so that raising may be performed in the usual manner. As soon as raising is stopped, and if lowering is attempted, the cam 72 once again will pivot in the counterclockwise direction to prevent descent and hold the load.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rescue system comprising a hoist including a backplate; a rope drum mounted on said backplate, said rope drum capable of rotation in one direction only; said rope drum having a front and rear end flanges on either side of a rope engaging surface; an arcuate rope guide including a thru slot fixed to said backplate and extending partially about said drum; a substantially T-shaped rope lock bar mounted on said rope guide adjacent said slot and extending substantially transverse to said rope guide and substantially between said front and rear end flanges of said rope drum to permit a rope extending through said rope guide and partially about said drum to be wrapped about said lock bar.

2. The rescue system of claim 1 wherein said backplate is formed with an attachment hole above said rope drum such that a vertical centerline of said backplate extends through said hole and through said axis of rotation of said rope drum, and wherein said rope guide extends circumferentially beyond said vertical centerline in said second direction.

3. The rescue system of claim 2 wherein said rope guide extends circumferentially beyond said vertical centerline about 60° in said second direction.

4. The rescue system of claim 2 wherein said at least one rope slot is formed with a wedge groove proximate said centerline.

5. A rescue system comprising a hoist including a backplate; a rope drum mounted on said backplate, said rope drum capable of rotation in one direction only; said rope drum having a front and rear end flanges on either side of a rope engaging surface, said rope engaging surface adapted to accommodate plural wraps of said rope; an arcuate rope guide including a thru slot fixed to said backplate and extending partially about said drum; and a cam lock assembly mounted to said backplate for rotation about an axis parallel to an axis of rotation of said rope drum, said cam lock assembly including a cam movable between an operative position wherein the rope is compressed between the cam and the rope engaging surface of the drum, and an inoperative position where said cam is spaced from said rope engaging surface of the drum, said cam located axially above said rope engaging surface adjacent said front end flange to thereby enable grabbing of a low tension wrap of the rope upstream of a load wrap.

6. The rescue system of claim 5 wherein said cam is biased toward the engaged position.

7. The rescue apparatus of claim 6 wherein said cam is pivotally secured within a body portion of the lock for rotation about a pin extending substantially parallel to the axis of rotation of the drum.

8. The rescue apparatus of claim 7 wherein said cam is fixed to a barrel portion and wherein a knob is attached to said barrel for axial movement toward and away from said barrel.

9. The rescue apparatus of claim 8 wherein the knob is biased by a compression spring toward said barrel.

10. A rescue system comprising: a hoist including a backplate; a rope drum mounted on the backplate for rotation about an axis extending substantially perpendicular to the backplate, said rope drum having a rope engaging surface located between a pair of circular end flanges; a rope guide fixed to said backplate, said rope guide formed by a pair of elongated laterally spaced legs connected at opposite ends of said rope guide to define therebetween at least one rope slot, said rope guide having an arcuate shape conforming substantially to said circular end flanges of said rope drum; a generally T-shaped rope lock bar mounted on a forward end of said rope guide, said lock bar including a stem and a cross bar, said cross bar extending substantially parallel to an axis of rotation of said rope drum; and a lock mounted on said backplate for movement between engaged and disengaged position, said lock including a cam movable between an operative position wherein the rope is compressed between the cam and the rope engaging surface of the drum, and an inoperative position where said cam is spaced from said rope engaging surface of the drum, said cam located axially above said rope engaging surface adjacent said front end flange to thereby enable grabbing of a low tension wrap of the rope upstream of a load wrap.

11. The rescue system of claim 10 wherein said backplate is formed with an attachment hole above said rope drum such that a vertical centerline of said backplate extends through said hole and through said axis of rotation of said rope drum, and wherein said rope guide extends circumferentially beyond said vertical centerline in said second direction.

12. The rescue system of claim 11 wherein said rope guide extends circumferentially beyond said vertical centerline about 60° in said second direction.

13. The rescue system of claim 11 wherein said at least one rope slot is formed with a wedge groove proximate said centerline.

14. The rescue system of claim 13 wherein said rope guide is mounted to said backplate by a plurality of mounting legs extending substantially perpendicularly to said backplate, at least two of said mounting legs partially defining an aperture in said rope guide behind said T-shaped lock bar and at least partially adjacent said wedge groove.

15. The rescue system of claim 10 wherein said cam is biased toward the engaged position.

16. The rescue apparatus of claim 15 wherein said cam is pivotally secured within a body portion of the lock for rotation about a pin extending substantially parallel to the axis of rotation of the drum.

17. The rescue apparatus of claim 16 wherein said cam is fixed to a barrel portion and wherein a knob is attached to said barrel for axial movement toward and away from said barrel.

18. The rescue apparatus of claim 17 wherein the knob is biased by a compression spring toward said barrel.

* * * * *